US008926011B2

(12) United States Patent
Clement

(10) Patent No.: US 8,926,011 B2
(45) Date of Patent: Jan. 6, 2015

(54) DENTAL PATIENT SEATING APPARATUS WITH HEAD REST AND TOOL STAGING ARM AND RELATED METHODS

(76) Inventor: Milton A. Clement, Orlando, FL (US)

( * ) Notice: Subject to any disclaimer, the term of this patent is extended or adjusted under 35 U.S.C. 154(b) by 266 days.

(21) Appl. No.: 13/403,424

(22) Filed: Feb. 23, 2012

(65) Prior Publication Data

US 2013/0221723 A1 Aug. 29, 2013

(51) Int. Cl.
*A47C 7/62* (2006.01)

(52) U.S. Cl.
USPC ..... 297/188.05; 297/188.21; 297/410

(58) Field of Classification Search
USPC ..... 297/410, 188.05, 188.06, 188.2, 188.21
See application file for complete search history.

(56) References Cited

U.S. PATENT DOCUMENTS

| | | | | |
|---|---|---|---|---|
| 2,306,294 | A * | 12/1942 | Brown et al. | 108/8 |
| 3,198,574 | A | 8/1965 | Ota et al. | |
| 3,226,160 | A * | 12/1965 | Page | 297/410 X |
| 3,259,430 | A | 7/1966 | Beach | |
| 3,731,383 | A | 5/1973 | Hayashi | |
| 3,802,736 | A | 4/1974 | Valeska et al. | |
| 3,936,091 | A | 2/1976 | Rabinowitz | |
| 4,114,274 | A | 9/1978 | Jones | |
| 4,126,939 | A | 11/1978 | Pyne, Jr. | |
| 4,209,907 | A | 7/1980 | Tsukada et al. | |
| 4,311,461 | A | 1/1982 | Hotta et al. | |
| 4,413,858 | A | 11/1983 | Beach | |
| 4,500,134 | A | 2/1985 | Kaneko et al. | |
| 5,281,136 | A | 1/1994 | Giannella et al. | |
| 5,575,646 | A | 11/1996 | Giannella | |
| 5,730,497 | A | 3/1998 | Raymond et al. | |
| 6,575,575 | B2 | 6/2003 | O'Brien et al. | |
| 6,626,496 | B2 | 9/2003 | Beach et al. | |
| 7,032,965 | B2 * | 4/2006 | Howell et al. | 297/16.1 |
| 7,111,814 | B1 | 9/2006 | Newman | |
| 7,195,219 | B2 | 3/2007 | Irwin et al. | |
| 7,784,864 | B2 | 8/2010 | Feder | |
| 7,862,112 | B2 | 1/2011 | Caturla et al. | |
| 2006/0169730 | A1 | 8/2006 | Morrison | |
| 2010/0160739 | A1 | 6/2010 | Van Lue | |

* cited by examiner

*Primary Examiner* — Anthony D Barfield
(74) *Attorney, Agent, or Firm* — Allen, Dyer, Doppelt, Milbrath & Gilchrist, P.A.

(57) ABSTRACT

A dental patient seating apparatus includes a dental chair having a chair body with a head rest receiving slot therein. The dental patient seating apparatus also includes a head rest having a head support to receive a patient's head thereagainst, and a coupling projection extending downwardly from the head support to be received in the head rest receiving slot for coupling to the dental chair. The dental patient seating apparatus includes a tool staging arm coupled to the head support.

15 Claims, 4 Drawing Sheets

DENTAL PATIENT SEATING APPARATUS WITH HEAD REST AND TOOL STAGING ARM AND RELATED METHODS

FIELD OF THE INVENTION

The present invention relates to the field of dental patient seating apparatuses, and, more particularly, to dental patient seating apparatuses including tool staging arms and related methods.

BACKGROUND OF THE INVENTION

Dentists can most conveniently work on patient's teeth with the patient in a reclining or semi-reclining position. As such, most dentists have patient chairs suitably designed for conveniently and comfortably placing the patient in this position. In addition, dental work commonly involves the use of a myriad of equipment, appliances, pads and other supplies, and it can be helpful to have these items located in a convenient place near the patient's head where they can be reached easily and quickly.

Attempts at additions to dental chairs to hold such equipment in a convenient place have been made. For example, U.S. Pat. No. 5,281,136 to Giannella et al. discloses a support and guide apparatus for a dental drill. This support and guide apparatus comprises an articulated arm, which can be attached to a fixed support member and provided with an attachment member for a tail of the drill. The arm is provided with a device that acts to maintain the axis of rotation of the drill orthogonal to a working plane and a counterweight that balances the weight of the movable parts. The apparatus further includes a stabilization apparatus for the head and jaw comprising a side bracket lockable with respect to the headrest of a dental chair, which carries a transverse element projecting therefrom to maintain the patient's jaw in the open position.

U.S. Pat. No. 7,195,219 to Irwin et al. discloses a system for adapting a dental chair for use, including, for example, use from the right side or left side, use by right-handed or left-handed practitioners, and use in various dentistry practice styles. The system includes a link arm, a primary arm, and a secondary arm. The secondary arm has multiple pivotably connected segments allowing its distal end to be positioned as desired.

These structures, however, may not be easily attachable to a dental chair. In addition, these structures may not provide the desired amount of adjustment of where dental tools are held. As such, further advances are desired.

SUMMARY OF THE INVENTION

In view of the foregoing background, it is therefore an object of the present invention to provide a dental patient seating apparatus providing enhanced access to dental tools.

This and other objects, features, and advantages in accordance with the present invention are provided by a dental patient seating apparatus that may include a dental chair comprising a chair body with at least one head rest receiving slot therein, and a head rest. The head rest may have a head support to receive a patient's head thereagainst, and at least one coupling projection extending downwardly from the head support to be received in the at least one head rest receiving slot for coupling to the dental chair. At least one tool staging arm may be coupled to the head support.

This dental patient seating apparatus allows easy storage and usage of dental tools near the patient's mouth, and provides a great degree of adjustability to accommodate different dental procedures and differently sized patients.

The at least one tool staging arm may comprise at least one support member coupled to the head support and extending outwardly therefrom, and a tool staging member adjustably coupled to the at least one support member so as to permit movement of the tool staging member in a Y-direction. In addition, the at least one support member may comprise a pair of support members. The tool staging member may then be adjustably coupled to each of the pair of support members. In some applications, the head support, the coupling projection, and the pair of support members may be integrally formed as a monolithic unit.

Further, the tool staging member may be adjustably coupled to the at least one support member so as to also permit movement of the tool staging member in an X-direction and a Z-direction. The coupling projection and the dental chair may have respective portions configured to allow adjustment of a depth that the coupling projection rests at in the head rest receiving slot. Also, the tool staging member may have at least one hole defined therein for receipt of a dental tool. The tool staging member may be semicircular in shape, and the at least one support member may be semicircular in shape. In some embodiments, the tool staging member may comprise a polycarbonate material.

A method aspect is directed to a method of making a dental patient seating apparatus. The method may include forming a dental chair comprising a chair body with at least one head rest receiving slot therein. The method may also include forming a head rest comprising a head support to receive a patient's head thereagainst, and at least one coupling projection extending downwardly from the head support to be received in the at least one head rest receiving slot for coupling to the dental chair. In addition, the method may further include coupling at least one tool staging arm to the head support.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

Figure 1:
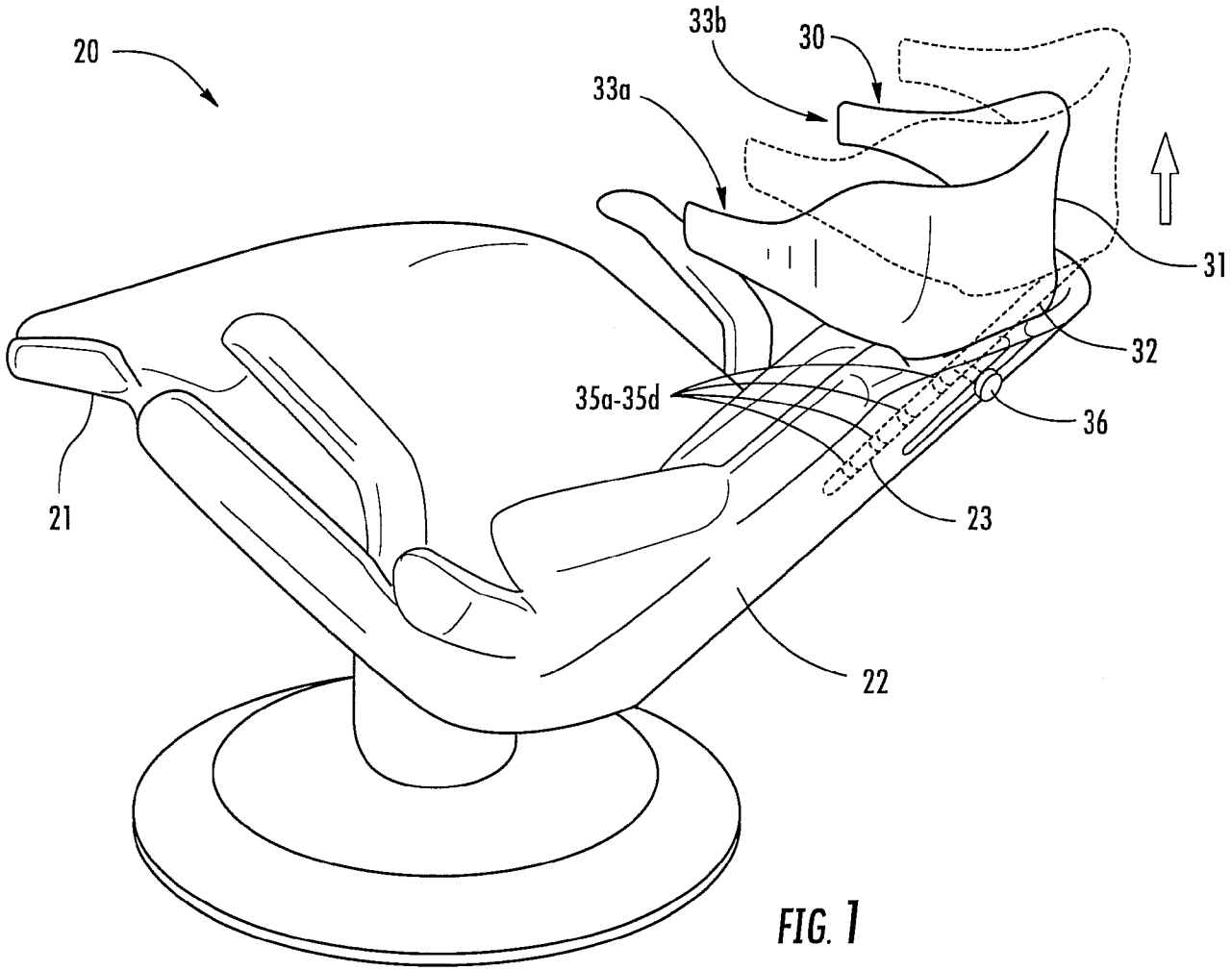
FIG. 1 is a perspective view of a dental patient seating apparatus, according to the present invention.

Referring initially to FIG. 1, a dental patient seating apparatus 20 according to the present invention is now described. The dental patient seating apparatus 20 illustratively includes comprises a dental chair 21, and a head rest 30 adjustably coupled thereto. The dental chair 21 comprises a chair body 22 with at least one head rest receiving slot 23 therein. The head rest 30 comprises a head support 31 to receive a patient's head thereagainst, and at least one coupling projection 32 extending downwardly from the head support. The coupling projection 32 is received in the head rest receiving slot 23 so as to couple the head rest 30 to the dental chair 21. The dental patient seating apparatus 20 illustratively includes a pair of tool staging arms 33*a*-33*b* coupled to the head support 31 on opposite left and right sides thereof.

As will be understood by those of skill in the art, the coupling of the head rest 30 to the dental chair 21 via the coupling projection 32 is particularly advantageous, as it allows removal of a typical prior art head rest from an existing dental chair and replacement therewith of the head rest of the present invention. Since most dental practices already own multiple dental chairs, this facilitates easy adoption of the head rest 30 of this invention into typical dental chairs.

It should be appreciated that, in some applications, there may be only one tool staging arm, and that there need not be two staging arms 33*a*-33*b*, such as in the illustrated embodiment. In addition, in other embodiments, there may be a front member extending between the pair of tool staging arms 33*a*-33*b*, as will be explained in detail below.

In the illustrated embodiment, the head support 31, the coupling projection 32, and the pair of tool staging arms 33*a*-33*b* are integrally formed as a monolithic unit, but it should be understood that in other embodiments, these pieces may be separately formed and rigidly and/or adjustably coupled together.

So as to allow adjustment of the depth of the coupling projection 32 in the head rest receiving slot 23, and thus the height of which the head rest 30 extends upwardly from the dental chair 21, the coupling projection and dental chair have respective portions 35*a*-35*d*, 36 configured to allow adjustment of the depth that the coupling projection rests at in the head rest receiving slot. In particular, the coupling projection 32 has a plurality of holes 35*a*-35*d* defined therein to receive a cross-pin 36 inserted through the dental chair 21. This allows adjustment of the head rest 30 for use with both taller and shorter patients, as shown with dashed lines in FIG. 1. Other depth setting arrangements are also contemplated, as will be appreciated by those skilled in the art. In other embodiments, the dental patient seating apparatus 20 may include a motor (e.g. computer numerical control (CNC)) configured to adjust the depth that the coupling projection 32 rests at in the head rest receiving slot 23, and a controller (not shown) coupled thereto for receiving input from the user. The controller may comprise, for example, a mechanical switch, or a digital control interface, such as a touch screen display coupled to a computing unit backend.

Figure 2:
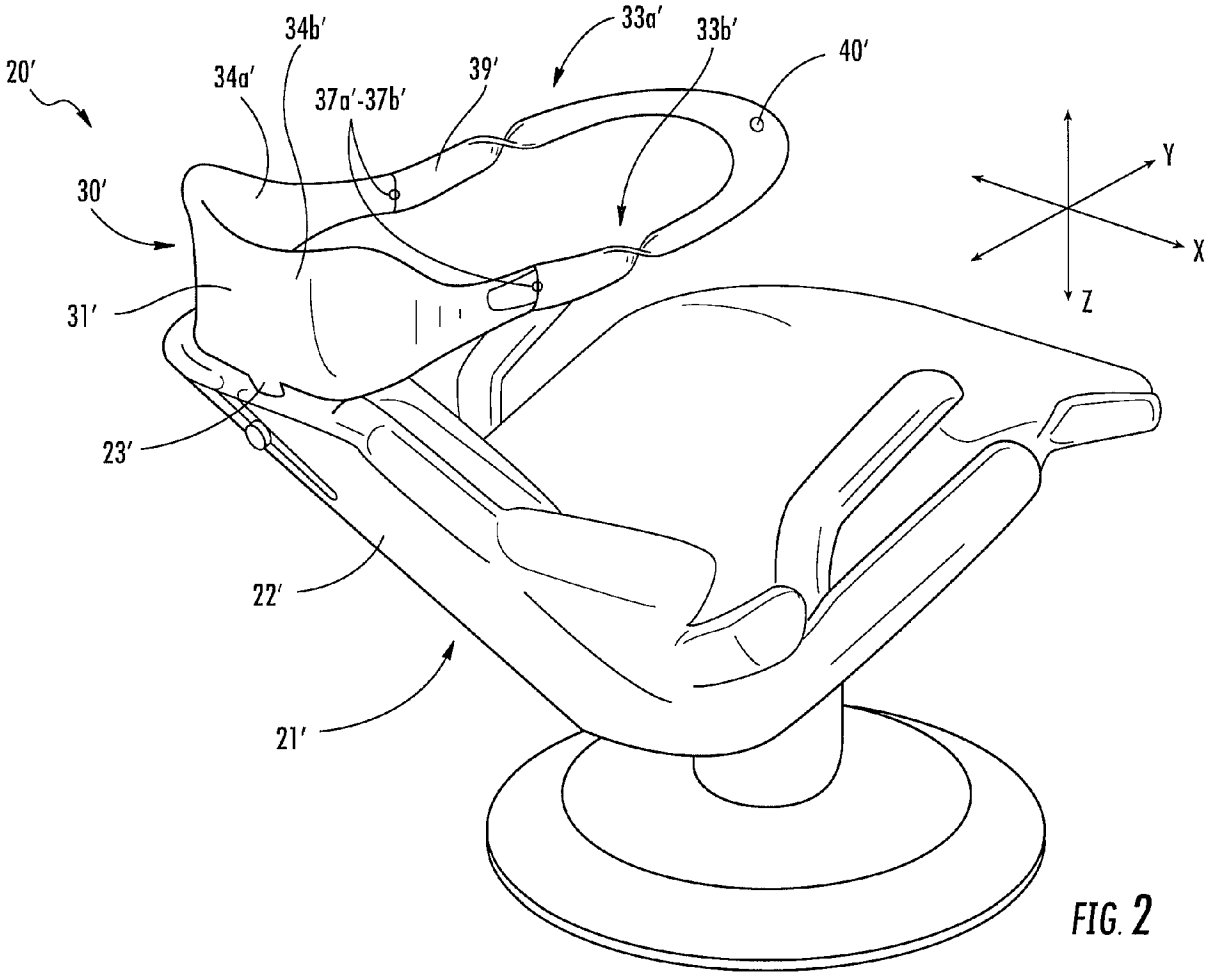
FIG. 2 is a perspective view of another embodiment of the dental patient seating apparatus, according to the present invention.

With reference to FIG. 2, another embodiment of a dental patient seating apparatus 20' is now shown. Here, the dental patient seating apparatus 20' also includes both a dental chair 21', and a dental head rest 30'. Here, the dental head rest 30' includes tool staging arms 33*a*'-33*b*', each including a support member 34*a*'-34*b*' coupled to the head support 31', and a tool staging member 39' adjustably coupled to the support members so as to permit movement of the tool staging member in the Y-direction. The tool staging member 39' is adjustably coupled to the pair of support members 34*a*'-34*b*' at the adjustment points 37*a*'-37*b*'. The coupling at the adjustment points 37*a*'-37*b*' also permits movement of the tool staging member 39' in the X-direction and the Z-direction. In some embodiments, the adjustment points 37*a*'-37*b*' may comprise a spring arrangement, and/or a pivoting point permitting movement in free space. In other embodiments, the dental head rest 30' may include a motor (e.g. CNC motor) configured to adjust movement of the tool staging member 39' in the X-direction and the Z-direction.

The tool staging member 39' illustratively includes a tool receiving hole 40' defined therein for receipt of a dental tool. This advantageously allows dental tools to be securely held in a location convenient for a dentist to reach.

As shown in FIG. 2, the tool staging member 39' is semicircular in shape. It should be appreciated, however, that the tool staging member 39' need not be semicircular in shape and may indeed take any suitable shape. The tool staging member 39' may comprise a metallic material or a polycarbonate material, such as Plexiglas.

Figure 3:
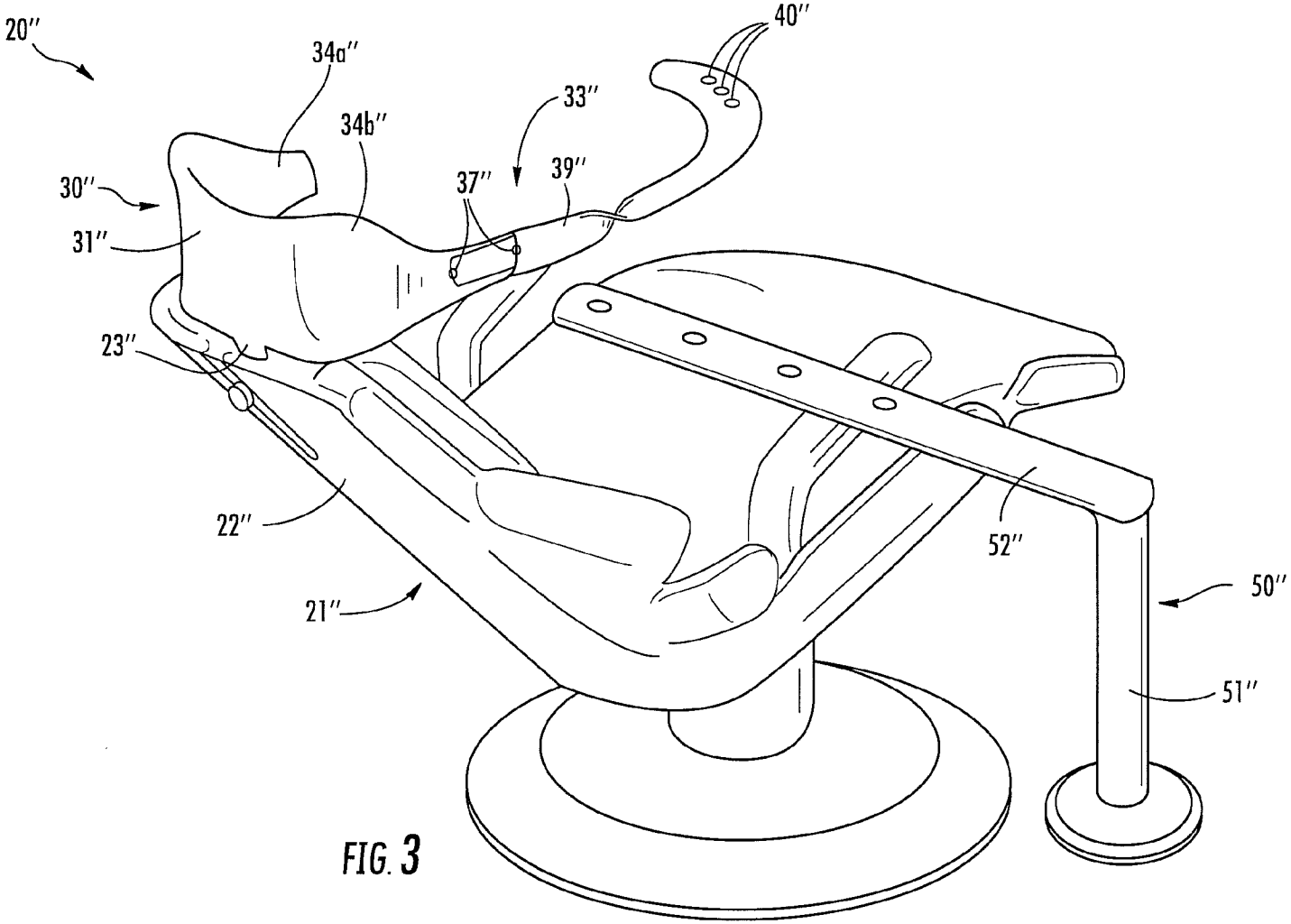
FIG. 3 is a perspective view of yet another embodiment of the dental patient seating apparatus, according to the present invention.

In addition, as shown in FIG. 3, the tool staging member 39" may be semicircular in shape and may not extend between the pair of support members 34*a*"-34*b*", but rather extend from one of the support members (34*b*"). In addition, as shown in FIG. 3, the dental patient seating apparatus 20" illustratively includes an additional tool staging arm 50" adjacent the dental chair 21" and configured to extend across a patient's lap. This additional tool staging arm 50" comprises a base 51" to be placed on the ground, and an arm 52" extending from the base. The arm 52" may be rotated with respect to the base 51", and may be coupled to the base via a telescoping arrangement allowing adjustment of the height from which the arm extends.

Figure 4:
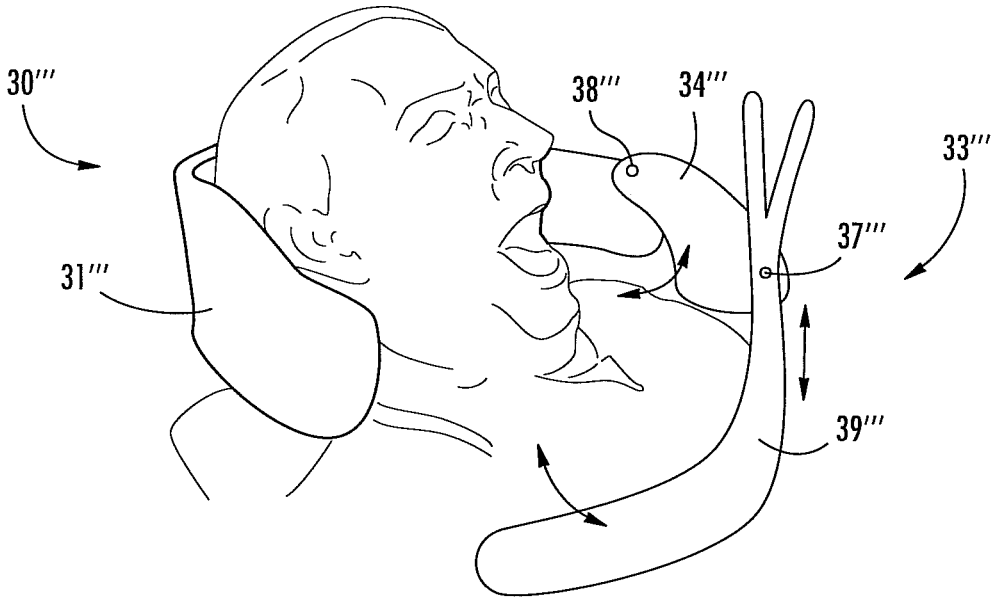
FIG. 4 is a perspective view of the dental head rest from the dental patient seating apparatus of FIG. 3.

Referring now to FIG. 4, the adjustability of the support member 34'" and tool staging arm 33'" of a similar embodiment is now described. Here, the support member 34'" may be adjusted in the X-direction (and thus up and down with respect to the patient's head) via the adjustable coupling 38'". The tool staging arm 33'" may be rotated toward the patient's face or away from the patient's face as desired and provided for by the adjustable coupling 37'". In other embodiments, the dental head rest 30'" may include at least one motor (e.g. CNC motor) configured to adjust movement of the support member 34'" and the tool staging arm 33'". In addition, the hinge point between the tool staging arm 33'" and support member 34'" may be adjusted, also by the adjustable coupling 37'". This renders the dental headrest 30'" particularly useful because a dentist can adjust it for differently sized patients and can configured it for different sorts of dental procedures.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A dental patient seating apparatus comprising:

a dental chair comprising a chair body with at least one head rest receiving slot therein;

a head rest comprising a head support to receive a patient's head thereagainst, and at least one coupling projection extending downwardly from said head support to be received in the at least one head rest receiving slot for coupling to said dental chair; and at least one tool staging arm comprising a pair of support members coupled to said head support and extending outwardly therefrom, and a tool staging member adjustably coupled to each of said pair of support members so as to permit movement of said tool staging member in a Y-direction.

2. The dental patient seating apparatus of claim 1 wherein said head support, said at least one coupling projection, and said pair of support members are integrally formed as a monolithic unit.

3. The dental patient seating apparatus of claim 1 wherein said tool staging member is adjustably coupled to said pair of support members so as to also permit movement of said tool staging member in an X-direction and a Z-direction.

4. The dental patient seating apparatus of claim 1 wherein said at least one coupling projection and said dental chair have respective portions configured to allow adjustment of a depth that said at least one coupling projection rests at in the head rest receiving slot.

5. The dental patient seating apparatus of claim 1 wherein said tool staging member has at least one hole defined therein for receipt of a dental tool.

6. The dental patient seating apparatus of claim 1 wherein said tool staging member is semicircular in shape.

7. The dental patient seating apparatus of claim 1 wherein said tool staging member comprises a polycarbonate material.

8. A dental patient seating apparatus comprising:

a dental chair comprising a chair body with at least one head rest receiving slot therein;

a head rest comprising a head support to receive a patient's head thereagainst, and at least one coupling projection extending downwardly from said head support to be received in the at least one head rest receiving slot for coupling to said dental chair;

at least one tool staging arm comprising a pair of support members coupled to said head support and extending outwardly therefrom, and a tool staging member adjustably coupled to each of said pair of support members so as to permit movement of said tool staging member in a Y-direction, and having at least one hole defined therein for receipt of a dental tool; and an additional tool staging arm adjacent said dental chair and configured to extend across said dental chair.

9. The dental patient seating apparatus of claim 8 wherein said head support, said at least one coupling projection, and said pair of support members are integrally formed as a monolithic unit.

10. The dental patient seating apparatus of claim 8 wherein said tool staging member is adjustably coupled to said pair of support members so as to also permit movement of said tool staging member in an X-direction and a Z-direction.

11. The dental patient seating apparatus of claim 8 wherein said at least one coupling projection and said dental chair have respective portions configured to allow adjustment of a depth that said at least one coupling projection rests at in the head rest receiving slot.

12. A method of making a dental patient seating apparatus comprising:

forming a dental chair comprising a chair body with at least one head rest receiving slot therein;

forming a head rest comprising a head support to receive a patient's head thereagainst, and at least one coupling projection extending downwardly from the head support to be received in the at least one head rest receiving slot for coupling to the dental chair;

coupling at least one tool staging arm to the head support; and forming the at least one tool staging arm to comprise a pair of support members coupled to the head support and extending outwardly therefrom, and a tool staging member adjustably coupled to each of the pair of support members so as to permit movement of the tool staging member in a Y-direction.

13. The method of claim 12 further comprising integrally forming the head support, the at least one coupling projection, and the pair of support members as a monolithic unit.

14. The method of claim 12 wherein the tool staging member is adjustably coupled to the pair of support members so as to also permit movement of the tool staging member in an X-direction and a Z-direction.

15. The method of claim 12 wherein forming of the at least one coupling projection and the dental chair includes forming the at least one coupling projection and the dental chair to have respective portions to allow adjustment of a depth that the at least one coupling projection rests at in the head rest receiving slot.

* * * * *